US012759770B2

(12) United States Patent
Bragg et al.

(10) Patent No.: US 12,759,770 B2
(45) Date of Patent: Oct. 13, 2026

(54) SPOUT FITMENT WITH REMOVABLE PORTION

(71) Applicant: Berry Global, Inc., Evansville, IN (US)

(72) Inventors: Jason Bragg, Chandler, IN (US); Karla Sue Koring, Mount Vernon, IN (US)

(73) Assignee: Berry Global, Inc., Evansville, IN (US)

( * ) Notice: Subject to any disclaimer, the term of this patent is extended or adjusted under 35 U.S.C. 154(b) by 24 days.

(21) Appl. No.: 18/381,954

(22) Filed: Oct. 19, 2023

(65) Prior Publication Data

US 2024/0132259 A1 Apr. 25, 2024
US 2024/0228132 A9 Jul. 11, 2024

Related U.S. Application Data

(60) Provisional application No. 63/417,537, filed on Oct. 19, 2022.

(51) Int. Cl.

| | |
|---|---|
| ***B65D 47/10*** | (2006.01) |
| ***B65D 41/02*** | (2006.01) |
| ***B65D 41/32*** | (2006.01) |
| ***B65D 47/12*** | (2006.01) |
| ***B65D 51/22*** | (2006.01) |
| *B65D 50/00* | (2006.01) |

(52) U.S. Cl.
CPC ..... *B65D 47/106* (2013.01); *B65D 41/02* (2013.01); *B65D 41/32* (2013.01); *B65D 47/12* (2013.01); *B65D 51/22* (2013.01); *B65D 50/00* (2013.01)

(58) Field of Classification Search
CPC ..... B65D 41/0457; B65D 41/0464; B65D 39/08; B65D 41/04; B65D 47/106; B65D 41/02; B65D 41/32; B65D 47/12; B65D 51/22; B65D 50/00; B65D 47/36; B65D 50/04; B65D 47/122
See application file for complete search history.

(56) References Cited

U.S. PATENT DOCUMENTS 5,303,837 A * 4/1994 Adams ..... B65D 47/121 220/276
5,348,182 A * 9/1994 Luch ..... B65D 39/00 215/253
5,348,184 A * 9/1994 Adams ..... B65D 39/0076 220/276
5,397,013 A * 3/1995 Adams ..... B65D 41/3409 222/541.9
5,680,968 A * 10/1997 Moore ..... B65D 51/20 222/545
5,709,318 A 1/1998 Oder
5,855,299 A * 1/1999 Arnold ..... B65D 25/48 222/571
5,868,283 A * 2/1999 Wilson ..... B65D 47/0876 222/536
6,032,829 A * 3/2000 Geisinger ..... B65D 39/08 215/209
6,209,762 B1 * 4/2001 Haffner ..... B65D 47/12 222/570
6,279,789 B1 * 8/2001 Krall ..... B65D 47/122 220/254.1

(Continued)

*Primary Examiner* — Kareen K Thomas
(74) *Attorney, Agent, or Firm* — Barnes & Thornburg LLP

(57) ABSTRACT

A closure with an overcap and fitment is disclosed, wherein the overcap is removably attachable to the fitment, and wherein the fitment includes a spout and a removable inner portion that may be removed to allow contents to pass through the fitment.

20 Claims, 8 Drawing Sheets

(56) References Cited

U.S. PATENT DOCUMENTS

| | | | | |
|---|---|---|---|---|
| 6,896,156 | B2 | 5/2005 | McDonald et al. | |
| 6,983,862 | B2 | 1/2006 | Nottingham et al. | |
| 7,000,808 | B2 | 2/2006 | Schuessler | |
| 7,014,078 | B2 | 3/2006 | Walsh et al. | |
| 7,097,076 | B1 * | 8/2006 | Giblin | B65D 47/122 222/569 |
| 7,175,051 | B2 | 2/2007 | McLelland et al. | |
| 7,673,774 | B2 | 3/2010 | Molloy et al. | |
| 7,789,277 | B2 | 9/2010 | Baughman et al. | |
| 7,959,034 | B2 | 6/2011 | Faaborg et al. | |
| 8,025,183 | B2 | 9/2011 | Szekely et al. | |
| 8,172,079 | B2 | 5/2012 | Greenberg et al. | |
| 8,231,025 | B2 | 7/2012 | Johnson | |
| 8,292,133 | B2 | 10/2012 | Baughman et al. | |
| 8,418,866 | B2 | 4/2013 | Perrin et al. | |
| 9,821,932 | B2 | 11/2017 | Quinn et al. | |
| 10,488,242 | B1 | 11/2019 | Scotton et al. | |
| 10,591,337 | B1 | 3/2020 | Neuhalfen et al. | |
| 10,946,400 | B2 | 3/2021 | Lamberto | |
| 2002/0056727 | A1 * | 5/2002 | Brecheisen | B65D 41/04 222/111 |
| 2002/0074347 | A1 | 6/2002 | Murray et al. | |
| 2005/0092750 | A1 * | 5/2005 | Lohrman | B65D 47/36 215/254 |
| 2007/0181603 | A1 | 8/2007 | Vangeel et al. | |
| 2010/0043910 | A1 * | 2/2010 | Szekely | B65D 47/06 220/729 |
| 2011/0204099 | A1 * | 8/2011 | Piscopo | B65D 47/32 141/381 |
| 2013/0175273 | A1 * | 7/2013 | Fox | B65D 25/48 220/259.3 |
| 2016/0229601 | A1 * | 8/2016 | Zweigart, Jr. | B65D 49/04 |
| 2016/0318670 | A1 * | 11/2016 | Piscopo | B65D 41/3423 |
| 2017/0210519 | A1 * | 7/2017 | Ware | B65D 81/30 |
| 2021/0031983 | A1 | 2/2021 | Azelton et al. | |
| 2021/0047086 | A1 | 2/2021 | Prusko et al. | |
| 2021/0229897 | A1 | 7/2021 | Abels et al. | |

* cited by examiner

SPOUT FITMENT WITH REMOVABLE PORTION

PRIORITY CLAIM

This application claims priority under 35 U.S.C. § 119(e) to U.S. Provisional Application Ser. No. 63/417,537, filed Oct. 19, 2022, which is expressly incorporated by reference herein.

TECHNICAL FIELD

The present disclosure relates generally to a fitment, and more specifically to a fitment with a spout and a removable portion.

BACKGROUND

It is often desirable to store product or contents in a container or package. It is often desirable to provide the container with a fitment and/or a closure for selectively dispensing the contents of the container. A removable portion may be included to seal or close a dispensing opening through the fitment and to be selectively removable at the option of a user. The fitment may be configured to couple to the container securably or permanently and an overcap may be removably attachable to the fitment, for example, via a threaded engagement. The overcap and fitment may form a closure that has child-resistant features.

SUMMARY

Certain embodiments according to the present disclosure provide a fitment for a container, the fitment having a spout and a removable portion. A measuring cup overcap may be provided and may have child resistant or locking features.

In one aspect, for instance, a closure for a container is provided having an overcap and a fitment. The overcap is removably attachable to a fitment. The fitment is securably attachable to the container. The fitment includes a spout, a lower portion having a lower portion side wall, and a floor. The floor of the fitment includes a frangible perimeter defining a removable inner portion, wherein the fitment is in a closed position when the removable inner portion is coupled to the fitment floor via the frangible perimeter. The removable inner portion may be removed from the fitment floor to provide the fitment in an open position in which liquid contents may flow through the fitment floor. The removable inner portion is coupled to a pull ring configured to allow a user to grasp the pull ring and remove the removable inner portion. The spout of the fitment includes a spout wall extending from a first end to a second end an angular $\alpha_1$ that is less than about 230 degrees.

In another aspect, for instance, a fitment for a container is provided having a spout, a lower portion having a lower portion side wall, and a floor. The floor of the fitment includes a frangible perimeter defining a removable inner portion. The fitment is in a closed position when the removable inner portion is coupled to the fitment floor via the frangible perimeter. The removable inner portion may be removed from the fitment floor to provide the fitment in an open position in which liquid contents may flow through the fitment floor. The removable inner portion is coupled to a pull ring configured to allow a user to grasp the pull ring and remove the removable inner portion. The spout of the fitment includes a spout wall extending from a first end to a second end an angular distance $\alpha_1$ that is less than about 230 degrees. The spout includes a funnel region having a radius of curvature extending a second angular distance $\alpha_2$ in the range of about 65 degrees to about 75 degrees. The radius of curvature of the funnel region is in the range of about 0.30" to about 0.50".

In yet another aspect, for instance, a fitment for a container is provided having a spout, a lower portion having a lower portion side wall, and a floor. The floor of the fitment includes a frangible perimeter defining a removable inner portion. The fitment is in a closed position when the removable inner portion is coupled to the fitment floor via the frangible perimeter. The removable inner portion may be removed from the fitment floor to provide the fitment in an open position in which liquid contents may flow through the fitment floor. The removable inner portion is coupled to a pull ring configured to allow a user to grasp the pull ring and remove the removable inner portion. The spout of the fitment includes a spout wall extending from a first end to a second end an angular distance $\alpha_1$ that is less than about 230 degrees. The floor is configured to allow drain back of the containers of a container, such as flowable contents having a viscosity, such as a laundry detergent, for example. The floor includes a first section, a second section, a third section, and a fourth section. The first section extends away from the lower portion side wall at a first floor angle $\beta_1$. The fourth section extends away from the lower portion side wall at a second floor angle $\beta_2$. The second section extends away from the first section at a fourth floor angle $\beta_4$. The third section extends away from the second section at a fifth floor angle $\beta_5$. The fourth section extends away from the third section at a third floor angle $\beta_3$.

BRIEF DESCRIPTION OF THE DRAWINGS

Embodiments now will be described more fully hereinafter with reference to the accompanying drawings, in which some, but not all embodiments may be shown. Indeed, embodiments may be illustrated or described in many different forms and the present disclosure should not be construed as limited to the embodiments set forth herein. Like numbers refer to like elements throughout, and wherein.

DETAILED DESCRIPTION

Embodiments now will be described more fully hereinafter with reference to the accompanying drawings, in which some, but not all embodiments may be shown. Indeed, embodiments may take many different forms and the present disclosure should not be construed as limited to the embodiments set forth herein; rather, these embodiments are provided so that this disclosure will satisfy applicable legal requirements. As used in the specification, and in the appended claims, the singular forms "a", "an", "the", include plural referents unless the context clearly dictates otherwise.

The terms "substantial" or "substantially" may encompass the whole as specified, according to certain embodiments, or largely but not the whole specified according to other embodiments.

Figure 1:
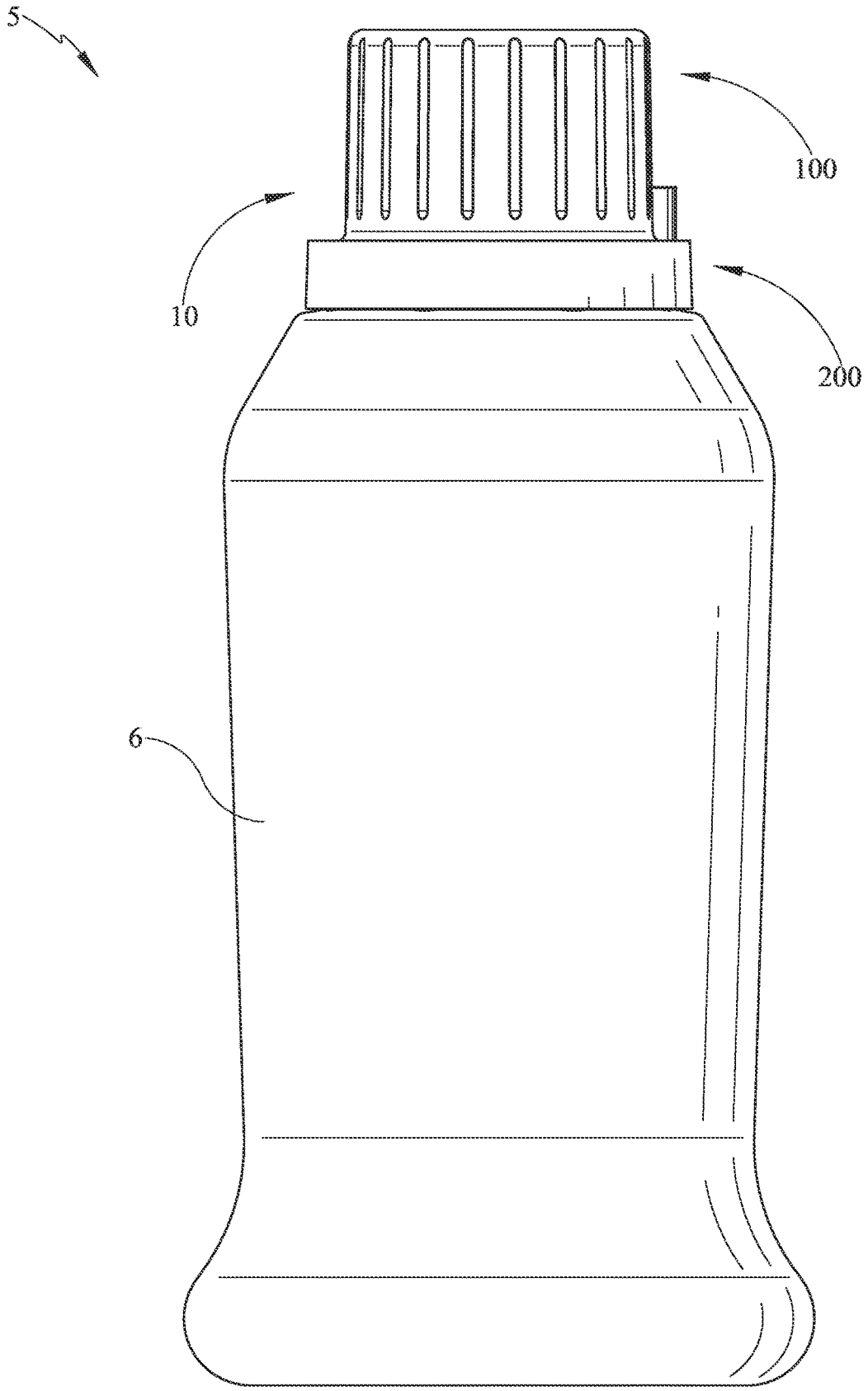
FIG. 1 illustrates a side view of an embodiment of a package having a container, a fitment, and an overcap.

Some embodiments of a package 5 may include a container 6 and/or a closure 10, as shown for example in FIG. 1. Container 6 may be configured to hold contents, such as detergent, for example, or other liquid contents or any other contents. Container 6 may have an opening near the top and/or defined by a neck through which the contents therein may be dispensed. Closure 10 may be provided such that it is securely coupled to container 6 to allow a user to selectively dispense the contents from container 6. Closure 10 may include an overcap 100 and/or a fitment 200. As discussed in more detail below, overcap 100 may include a measuring cup to allow a user to dispense a measured amount of contents, or for any other reason, and/or fitment 200 may include a spout to facilitate dispensing and/or pouring contents from container 6 into overcap or measuring cup 100.

Figure 2:
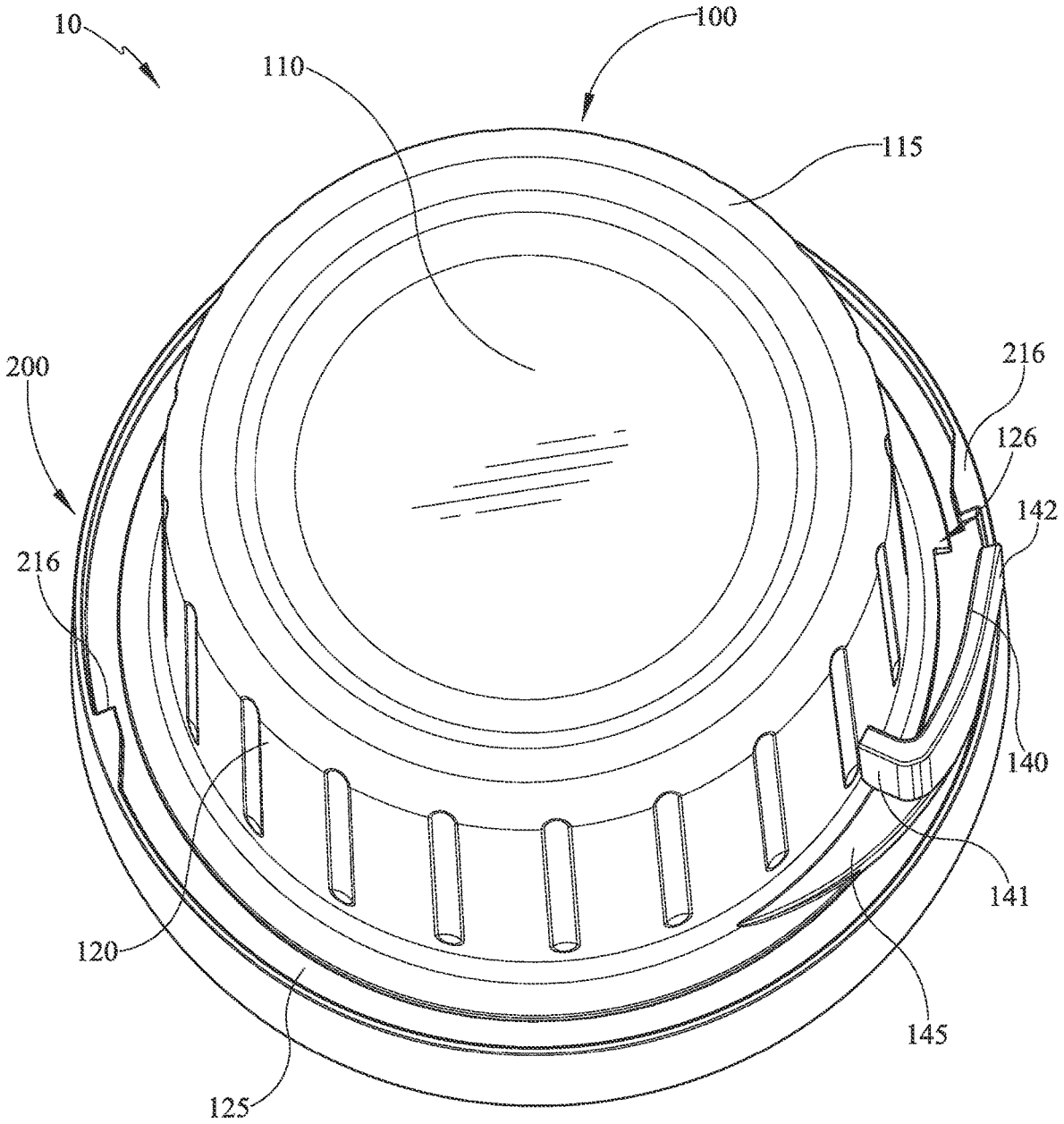
FIG. 2 illustrates a top perspective view of a closure that includes the fitment and overcap shown in FIG. 1, the fitment configured to couple to the container.

Overcap 100 may be removably attachable to fitment 200 to provide closure 10, as shown for example in FIG. 2. Overcap 100 may be rotatable relative to fitment 200 to move overcap 100 between a closed position in which it is coupled to fitment 200, as shown in FIG. 2, and an open position in which it is detached or removed from fitment 200. For example, overcap 100 and fitment 200 may have corresponding threads to allow relative rotational movement, as discussed in more detail below. Overcap 100 may include a top wall 110 and/or a raised area 115 that may cooperate with an upper side wall 120 and/or a lower side wall 130 to at least partially define a cup region 109, which may be used as a measuring cup or the like, for example (see, e.g., FIG. 8). Overcap 100 may include a flange 125 that may extend outwardly from upper side wall 120, for example, to cooperate with a shelf 214 of fitment 200 and/or to allow flange 125 and/or overcap 100 to rest on and/or be supported by shelf 214 and/or fitment 200. Shelf 214 may provide a mechanical stop when contacted by flange 125 to further prevent axial movement of overcap 100 relative to fitment 200 in a closing direction. Overcap 100 may be rotated relative to fitment 200, for example clockwise (CW), to cause overcap 100 and/or fitment 200 to move relative to one another in the closing direction, in which they move toward each other and/or in a direction of increasing axial overlap in a first axial direction. Overcap 100 may be rotated relative to fitment 200, for example counter-clockwise (CCW), to cause axial movement of overcap 100 relative to fitment 200 in an opening direction or a second axial direction opposite the first axial direction.

To block opening rotation, or for any other reason, fitment 200 may include one or more blocks 216 and/or overcap 100 may include one or more locking tabs 140, as shown for example in FIG. 2. Locking tab 140 may include a tab stem 141 that extends radially outwardly from upper side wall 120 of overcap 100 and/or locking tab 140 may extend in a circumferential direction away from tab stem 141 toward a tab end 142. Tab end 142 may be configured such that it would contact block 216 and/or prevent rotation or movement of overcap 100 in the opening direction relative to fitment 200 when locking tab 140 is in a resting or locked position. A user may engage locking tab 140, for example, by depressing it inwardly toward upper side wall 120 to move it and/or tab end 142 out of circumferential alignment with block 216 and/or into an unlocked position in which overcap 100 is free to rotate relative to fitment 200 from the closed position to the open position. To facilitate depressing locking tab 140 into an unlocked position, or for any other reason, overcap 100 and/or flange 125 may include a flange notch 126 to provide an area into which locking tab 140 may be depressed. Block 216 may be configured to allow rotation of overcap 100 relative to fitment 200 in a CW or closing direction with depression of locking tab 140, for example, by including an angled or cam surface in a position that locking tab 140 would contact when rotating in the closing direction. A tab rib 145 may be included for any of a variety of reasons, including adding rigidity or strength to locking tab 140. If included, tab rib 145 may flare out from side wall 120 and/or attach to locking tab 140 and/or tab stem 141, for example, at a bottom side of tab stem 141.

Figure 3:
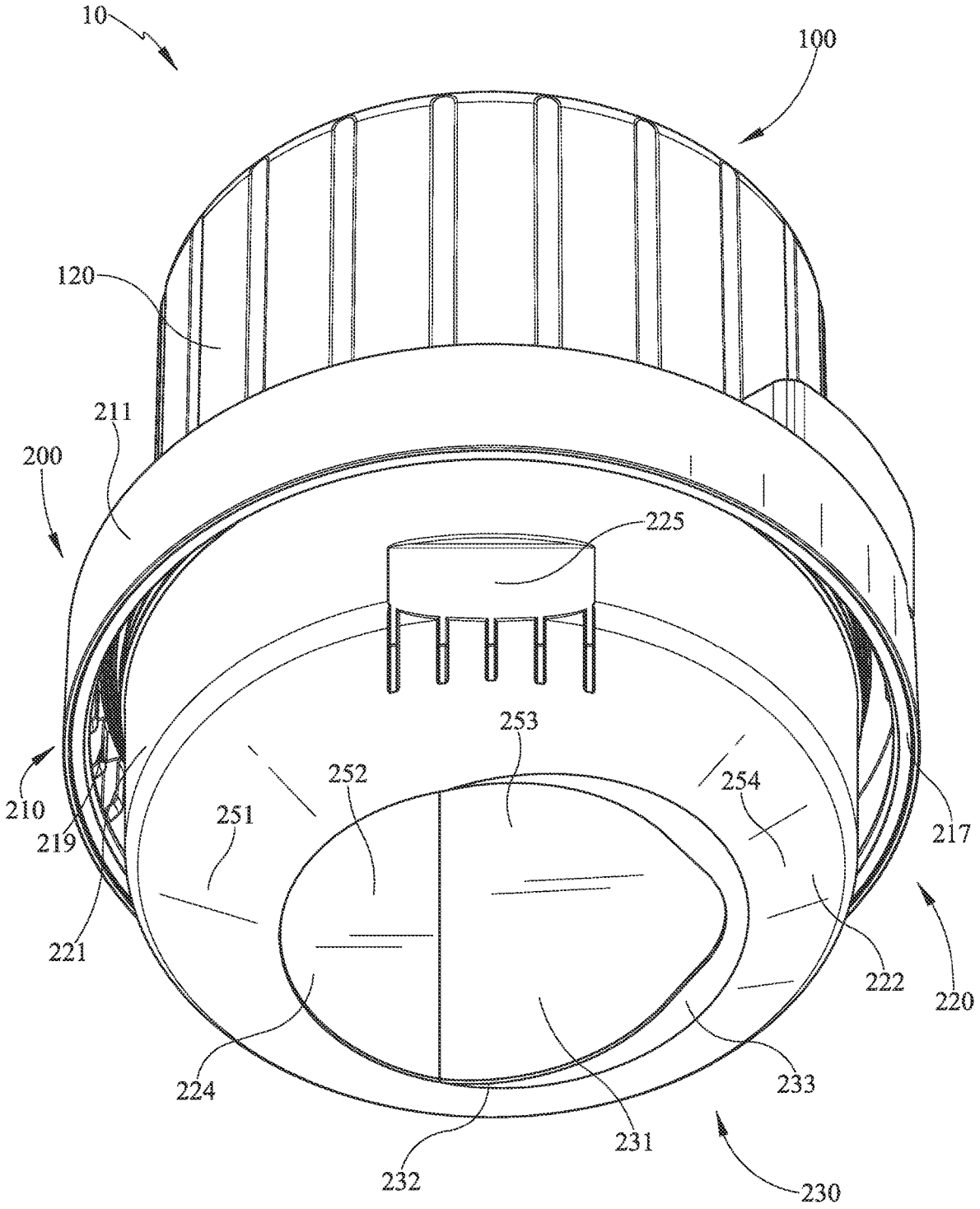
FIG. 3 illustrates a bottom perspective view of the fitment and overcap shown in FIG. 2.
Figure 4:
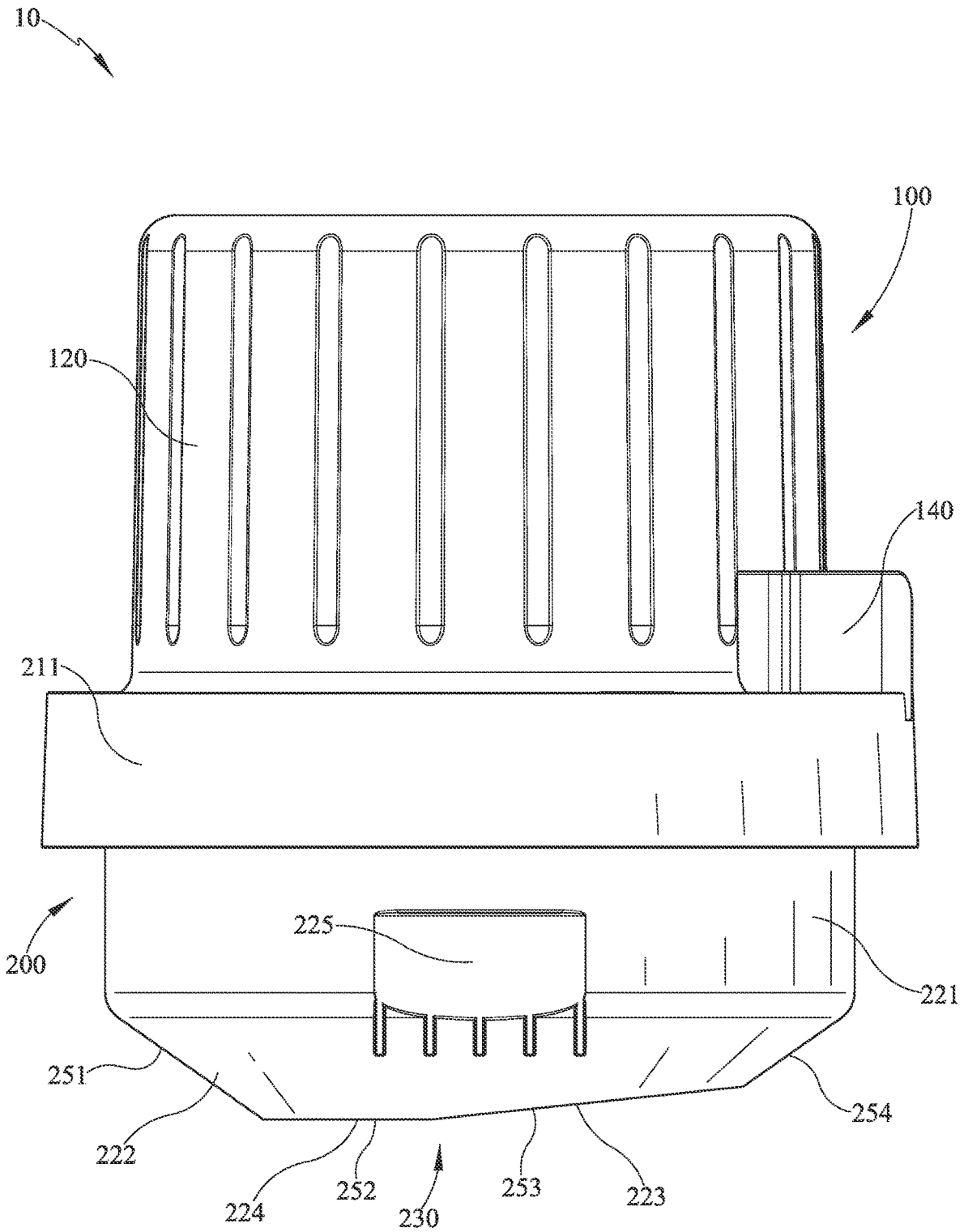
FIG. 4 illustrates a side view of the fitment and overcap shown in FIG. 2.

When overcap 100 is coupled to fitment 200 in a closed position as shown for example in FIGS. 2 through 4, top wall 110 and/or upper side wall 120 may prevent discharge of contents from container 6 to the environment. Fitment 200 may be configured to be securably attachable to container 6, for example, by coupling fitment 200, an upper portion 210, and/or a lower portion 220 with container 6. Fitment 200 and/or upper portion 210 may include an upper portion side wall 211, which may include at a lower end thereof an attachment feature such as snap bead 217 for securable and/or non-removable coupling of fitment 200 to container 6. Fitment 200 may include a lower portion 220, which may include a lower portion side wall 221 that may be configured to be inserted at least partially into container 6 and/or a neck thereof.

Lower portion 220 may include a chamfered or angled area or plug 222, for example, to facilitate insertion into container 6 and/or engagement of snap bead 217 with container 6, as shown for example in FIG. 4. Fitment 200 may include a feature to facilitate insertion and/or retention in container 6, such as one or more fitment protrusions 225. For example, if included two diametrically opposite fitment protrusions 225 may be included. Lower portion 220 may include a floor 230, which may include a first bottom area 223 and/or a second bottom area 224. First bottom area 223 may be relatively steep, and/or second bottom area 224 relatively gradual for any of a variety of reasons, including but not limited to facilitating drain back of contents from fitment 200 back into container 6, as shown for example in FIG. 4. Lower portion 220 and/or floor 230 may be configured to provide drain back of flowable contents of container 6, such as laundry detergent, for example, having a predetermined viscosity. For example, the relative angles of the sections of lower portion 220 discussed below may be altered and/or configured for varying flowability and/or viscosity. Lower portion 220 and floor 230 are discussed in more detail below with reference to the cross-section view of FIG. 7.

Floor 230 and/or fitment 200 may include a removable portion 231, which may be connected to the rest of floor 230 and/or fitment 200 via a frangible perimeter 232. For example, frangible perimeter 232 may be scored, perforated, or the like to make it easier to break than surrounding areas. Removable portion 231 may block or prevent passage of contents through fitment 200 until it is removed to provide an open position in which contents can pass through an opening created by removal of removable inner portion 231.

Figure 5:
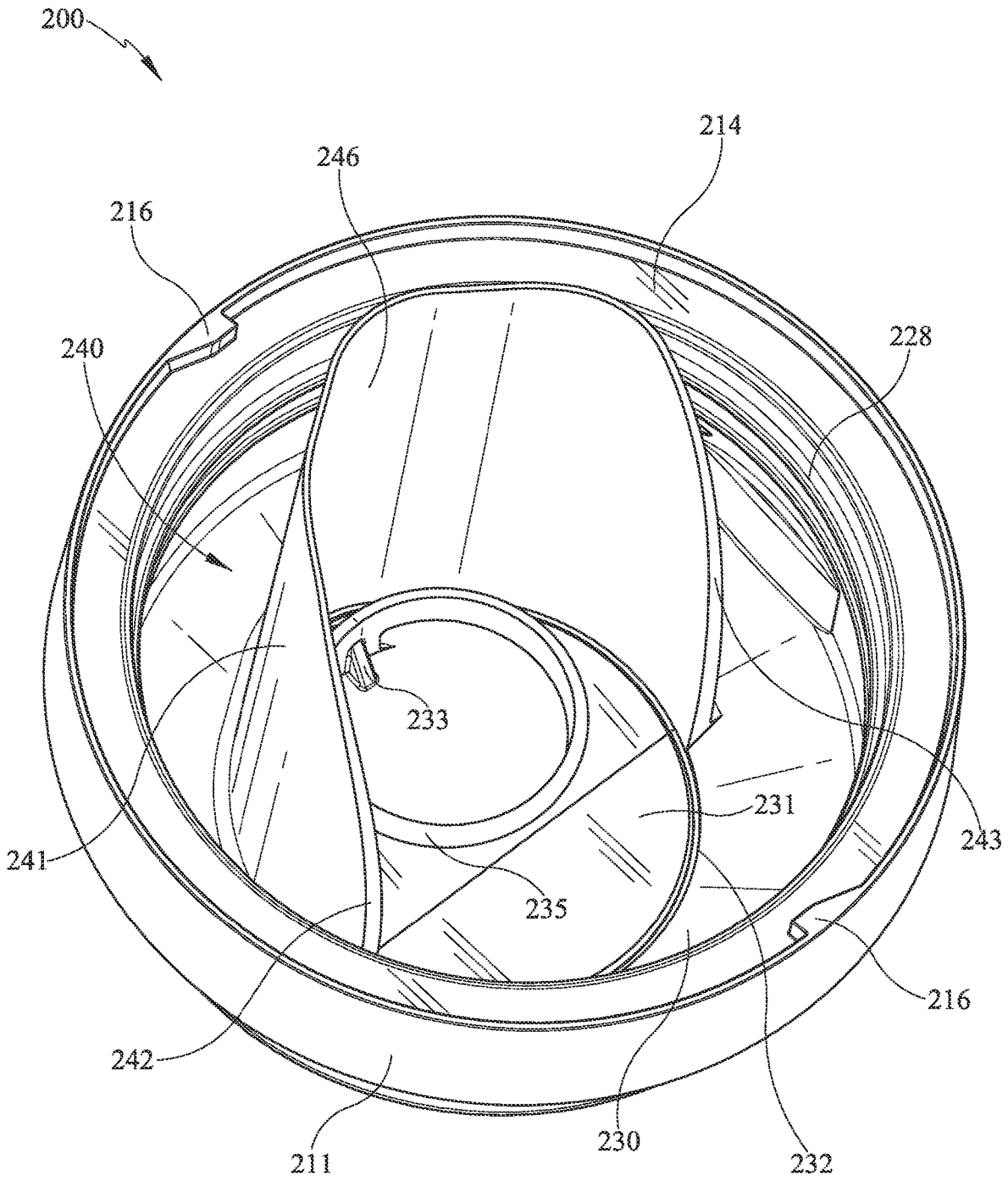
FIG. 5 illustrates a top perspective view of the fitment of FIG. 2 with the overcap removed, illustrating an upwardly extending spout and a removable portion coupled to a pull ring to facilitate removal, the fitment including an internal thread for threaded engagement with the overcap and locking tabs for selectively blocking removal of the overcap from the fitment.
Figure 6:
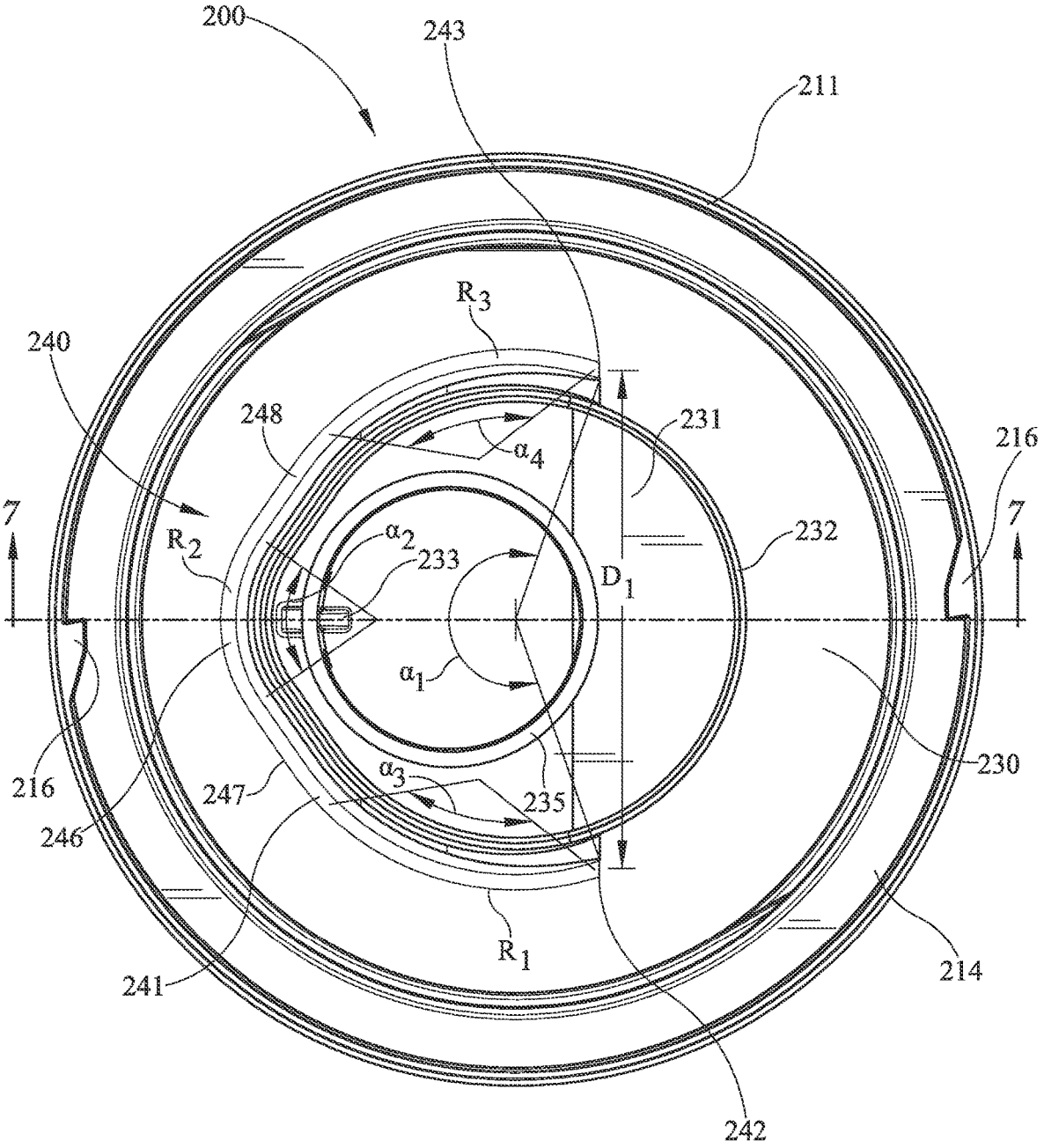
FIG. 6 illustrates a top view of the fitment of FIG. 5.

A pull ring 235 may be coupled to removable inner portion 231, for example via a stem 233, as shown for example in FIGS. 5 and 6, to facilitate removal of removable inner portion 231 to provide an open position of fitment 200, or for any other reason or combination of reasons. Pull ring 235 may be configured to allow a user to insert one or more fingers therein to grasp and remove it. For example, pull ring 235 may have an inside width, such as an inside diameter, of about 0.80" (+/−about 0.10"). Stem 233 of pull ring 235 may be located proximate spout 240 and/or funnel region 246, and/or opposite the opening between first end 242 and second end 243. This configuration may facilitate a user grasping pull ring 235 and using it to remove removable portion 231.

Fitment 200 may include a spout 240, which may facilitate pouring of contents, for example from container 6, through fitment 200, and into measuring cup or overcap 100. Spout 240 may include a spout wall 241, which may extend around a central axis or fitment axis from a first end 242 to a second end 243. Spout 240 and/or spout wall 241 may include a funnel region 246 as shown for example in FIG. 5 to facilitate pouring or for any other reason.

As shown for example in FIG. 6, spout wall 241 may extend from first end 242 to second end 243 a first angular distance $\alpha_1$ about the central axis or fitment axis. In some embodiments, first angular distance $\alpha_1$ may be between about 180 degrees and about 300 degrees, between about 200 degrees and about 250 degrees, between about 210 degrees and about 240 degrees, between about 215 degrees and about 225 degrees, and/or about 220 degrees. In some embodiments, first angular distance $\alpha_1$ may be less than about 300 degrees, less than about 280 degrees, less than about 260 degrees, less than about 250 degrees, less than about 240 degrees, less than about 230 degrees, and/or less than about 220 degrees.

Having spout wall 241 extend first angular distance $\alpha_1$ in the range described above may provide an open area between first end 242 and second end 243 suitable for allowing a user to insert a hand or a portion of a hand (e.g., a finger and/or a thumb) to grasp pull ring 235 and/or remove removable inner portion 231 to provide fitment 200 in an open or pouring position. First end 242 and second end 243 of spout 240 may be separated a linear distance $D_1$ that is greater than a diameter, such as an inside diameter, of pull ring 235. For example, linear distance $D_1$ may be about 1.40".

As shown in FIG. 6, spout 240 may include a first section $R_1$ adjacent first end 242, which may be rounded, for example, having a radius of about 0.75". First section $R_1$ may extend a third angular distance $\alpha_3$ of about 67 degrees. Spout 240 may include a second section 247 adjacent first section $R_1$. Second section 247 may be a relatively straight section and/or may have a length of about 0.25", for example. Spout 240 may include a funnel region 246 and/or a third section $R_2$ adjacent second section 247, which may be rounded and/or have a radius of curvature smaller than that of first section $R_1$. For example, third section $R_2$ may have a radius of about 0.40". Third section $R_2$ may extend a second angular distance $\alpha_2$ of about 70 degrees. Spout 240 may include a fourth section 248 adjacent third section $R_2$. Fourth section 248 may be a relatively straight section and/or may have a length of about 0.25", for example. Spout 240 may include a fifth section $R_3$ adjacent fourth section 248 and/or second end 243. Fifth section $R_3$ may be rounded, for example, having a radius of about 0.75". Fifth section $R_3$ may extend a fourth angular distance $\alpha_4$ of about 67 degrees.

Figure 7:
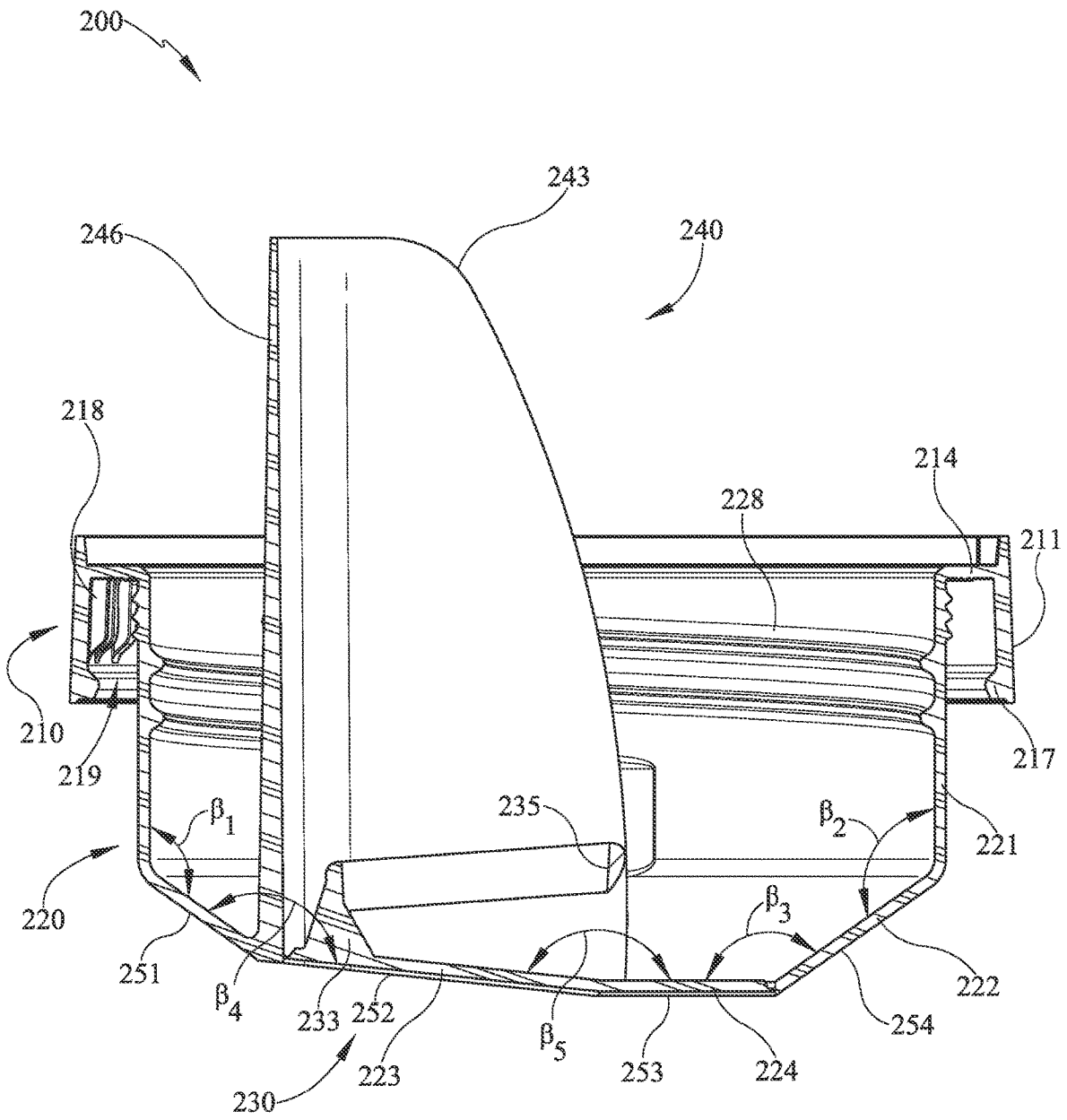
FIG. 7 illustrates a cross-section side view of the fitment of FIG. 6.

As shown in FIG. 7, lower portion 220 and/or floor 230 may include sections at varying angles to one another. For example, a first floor section 251 may extend at a first floor angle $\beta_1$ relative to side wall 221, a second floor section 252 may extend at a fourth floor angle $\beta_4$ relative to first floor section 251, a third floor section 253 may extend at a fifth floor angle $\beta_5$ relative to second floor section 252, and/or a fourth floor section 254 may extend at a third floor angle $\beta_3$ relative to third floor section 253 and/or at a second floor angle $\beta_2$ relative to side wall 221. As illustrated in FIG. 7, for example, $\beta_1$ may be about 125 degrees, $\beta_2$ may be about 125 degrees, $\beta_3$ may be about 145 degrees, $\beta_4$ may be about 151 degrees, and/or $\beta_5$ may be about 174 degrees.

Figure 8:
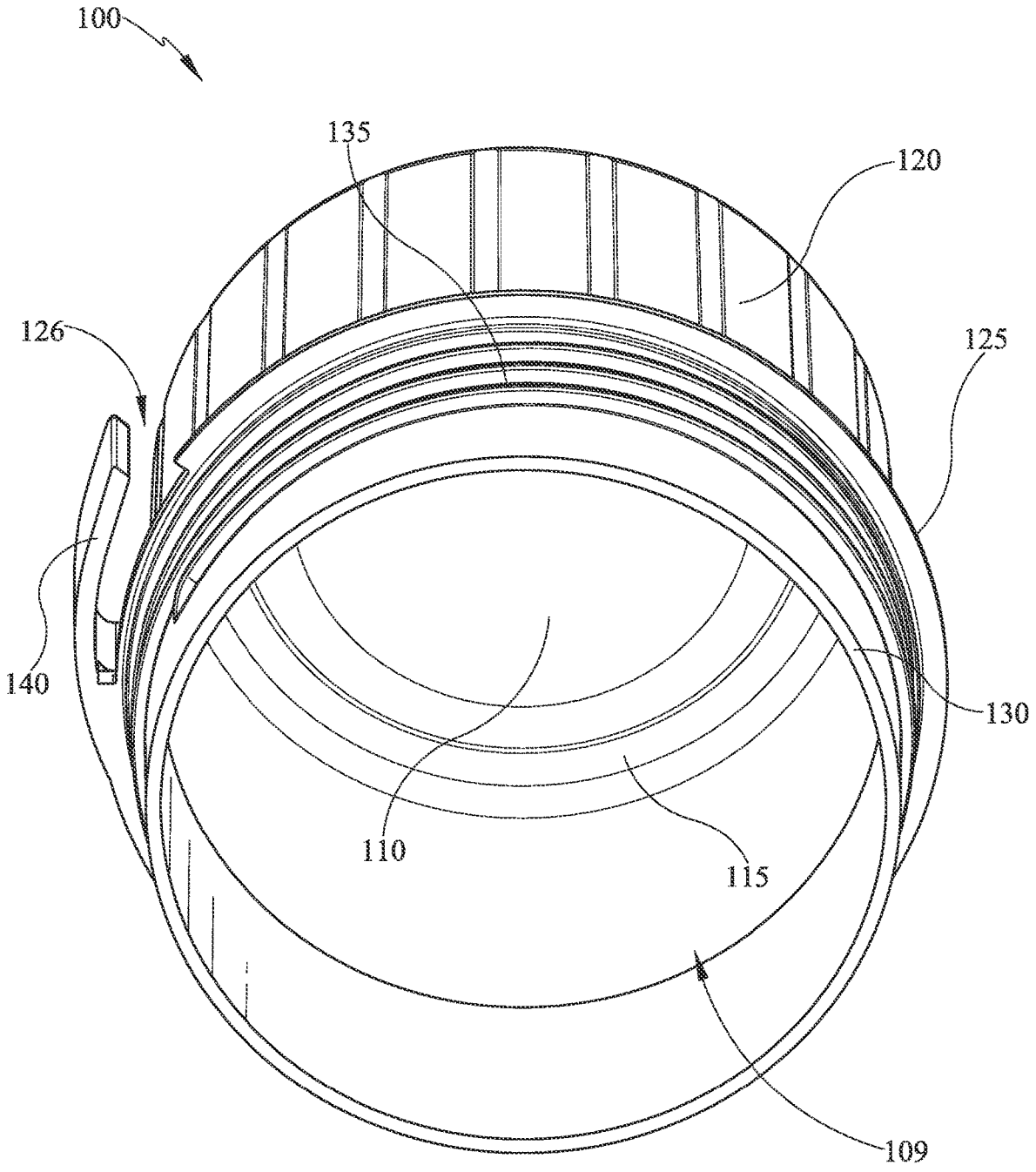
FIG. 8 illustrates a bottom perspective view of the overcap of FIG. 1.

Overcap 100 may include a lower side wall 130, which may include an external thread 135, as shown for example in FIG. 8. External thread 135 of lower side wall 130 may engage internal thread 228 of fitment 200, for example, to allow rotational attachment and/or removal of overcap 100 relative to fitment 200.

The dimensions provided are merely exemplary, and it is understood that these dimensions could vary in these or other embodiments. In some embodiments, for example, linear dimensions may vary by about +/−0.10" and/or angular dimensions may vary by about +/−5 degrees. In these or other embodiments, for example, the following dimensions may be approximately in the ranges of about:

$\alpha_1$: 215 degrees to about 225 degrees
$\alpha_2$: 65 degrees to about 75 degrees
$\alpha_3$: 62 degrees to about 72 degrees
$\alpha_4$: 62 degrees to about 72 degrees
$\beta_1$: 120 degrees to about 130 degrees
$\beta_2$: 120 degrees to about 130 degrees
$\beta_3$: 140 degrees to about 150 degrees
$\beta_4$: 146 degrees to about 156 degrees
$\beta_5$: 169 degrees to about 179 degrees
$R_1$: 0.65" to about 0.85"
$R_2$: 0.30" to about 0.50"
$R_3$: 0.65" to about 0.85"
$D_1$: 1.30" to about 1.50"
Length of second section 247: 0.15" to about 0.35"
Length of fourth section 248: 0.15" to about 0.35"

It is also understood that, while fitment 200 and overcap 100 are shown as generally cylindrical, fitment 200 and/or overcap 100 may take any of a variety of shapes.

It is understood that package 5 and/or closure 10, and/or any component thereof, may be made of any of a variety of materials, including, but not limited to, any of a variety of suitable plastics material, any other material, or any combination thereof. Suitable plastics material may include, but is not limited to, polypropylene (PP), polyethylene (PE), polyethylene terephthalate (PET), polystyrene (PS), high-density polyethylene (HDPE), low-density polyethylene (LDPE), linear low-density polyethylene (LLDPE), crystallized polyethylene terephthalate (CPET), mixtures and combinations thereof, or any other plastics material or any mixtures and combinations thereof. It is understood that multiple layers of material may be used for any of a variety of reasons, including to improve barrier properties, or to provide known functions related to multiple layer structures. The multiple layers, if included, may be of various materials, including but not limited to those recited herein.

It is further understood that package 5 and/or closure 10, and/or any component thereof, may be substantially rigid, substantially flexible, a hybrid of rigid and flexible, or any combination of rigid, flexible, and/or hybrid, such as having some areas be flexible and some rigid. It is understood that these examples are merely illustrative, are not limiting, and are provided to illustrate the versatility of options available in various embodiments of package 5 and/or closure 10, and/or any component thereof.

It is further understood that any of a variety of processes or combination thereof may be used to form package 5 and/or closure 10, and/or any component thereof, or any layer or substrate used therein. For example, any component, layer, or substrate, or combination thereof, may be compression molded, thermoformed, injection molded, injection stretch blow molded, blow molded, extrusion blow molded, coextruded, subjected to any other suitable process, or subjected to any combination thereof. In some embodiments, package 5 and/or closure 10, and/or any component thereof may be formed substantially of injection molded and/or thermoformed suitable plastics material, although other materials and forming processes may be used instead of or in addition to injection molding and thermoforming, respectively. Various materials and/or processes may be used to form package 5 and/or closure 10, and/or any component thereof, as will be understood by one of ordinary skill in the art. In some embodiments, package 5 and/or closure 10, and/or any component thereof, may be substantially a one-piece design and/or substantially formed as an integral or unitary structure.

It is understood that, while some directional terms are used herein, such as top, bottom, upper, lower, inward, outward, upward, downward, etc., these terms are not intended to be limiting but rather to relate to one or more exemplary orientations, positions, and/or configurations of package 5 and/or closure 10, and/or any component thereof. It is understood package 5 and/or closure 10, and/or any component or portion thereof may be inverted or re-oriented to face or point a different direction without departing from the nature of package 5 and/or closure 10 disclosed herein.

These and other modifications and variations may be practiced by those of ordinary skill in the art without departing from the spirit and scope, which is more particularly set forth in the appended claims. In addition, it should be understood that aspects of the various embodiments may be interchanged in whole or in part. Furthermore, those of ordinary skill in the art will appreciate that the foregoing description is by way of example only, and it is not intended to limit the scope of that which is described in the claims. Therefore, the spirit and scope of the appended claims should not be limited to the exemplary description of the versions contained herein.

That which is claimed:

1. A closure assembly, comprising:

an overcap and a fitment;

the overcap removably attachable to the fitment;

the fitment configured to be securably attachable to a container;

wherein the fitment includes a spout, a lower portion having a lower portion side wall, and a floor;

wherein the floor of the fitment includes a frangible perimeter defining a removable inner portion, wherein the fitment is in a closed position when the removable inner portion is coupled to the fitment floor via the frangible perimeter;

wherein the removable inner portion may be removed from the fitment floor to provide the fitment in an open position in which liquid contents may flow through the fitment floor;

wherein the removable inner portion is coupled to a pull ring configured to allow a user to grasp the pull ring and remove the removable inner portion;

wherein the spout of the fitment includes a spout wall extending from a first end to a second end an angular distance $\alpha_1$; and wherein the angular distance $\alpha_1$ is less than 230 degrees.

2. The closure assembly of claim 1, wherein the first end and the second end are separated by a linear distance that is greater than a width of the pull ring, wherein the linear distance is configured to allow the user to insert a hand or a portion of a hand into the spout to grasp the pull ring and remove it.

3. The closure assembly of claim 2, wherein the linear distance is at least 1.40".

4. The closure assembly of claim 1, wherein the overcap includes a child resistant locking mechanism.

5. The closure assembly of claim 4, wherein the overcap includes a locking tab that is movable between a locked position and an unlocked position, wherein a block on the fitment prevents rotation of the overcap relative to the fitment when the locking tab is in the locked position, and wherein the overcap may rotate relative to the fitment when the locking tab is in the unlocked position.

6. The closure assembly of claim 5, wherein the locking tab includes a tab stem extending outwardly from an overcap sidewall in a radial direction, and the locking tab extends circumferentially away from the tab stem toward a tab end, wherein the tab end is movable in the radial direction relative to the tab stem between the locked position and the unlocked position.

7. The closure assembly of claim 6, further comprising an overcap flange extending radially outwardly from the overcap sidewall and configured to rest on or adjacent a fitment shelf when the overcap is coupled to the fitment.

8. The closure assembly of claim 7, wherein the overcap flange includes a flange notch to allow the locking tab to move radially inwardly from the locked position toward the unlocked position.

9. A fitment, comprising:

a spout;

a lower portion having a lower portion side wall; and a floor;

wherein the floor of the fitment includes a frangible perimeter defining a removable inner portion, wherein the fitment is in a closed position when the removable inner portion is coupled to the fitment floor via the frangible perimeter;

wherein the removable inner portion may be removed from the fitment floor to provide the fitment in an open position in which liquid contents may flow through the fitment floor;

wherein the removable inner portion is coupled to a pull ring configured to allow a user to grasp the pull ring and remove the removable inner portion;

wherein the spout of the fitment includes a spout wall extending from a first end to a second end an angular distance $\alpha_1$;

wherein angular distance $\alpha_1$ is less than 230 degrees; and wherein the spout includes a funnel region having a radius of curvature extending a second angular distance $\alpha_2$.

10. The fitment of claim 9, wherein the second angular distance $\alpha_2$ is in the range of 65 degrees to 75 degrees.

11. The fitment of claim 9, wherein the radius of curvature of the funnel region is in the range of 0.30" to 0.50".

12. The fitment of claim 9, further comprising a first section of the spout proximate the first end of the spout wall and a second section of the spout proximate the second end of the spout wall, wherein the first section has a first section radius of curvature and the second section has a second section radius of curvature.

13. The fitment of claim 12, wherein at least one of the first section radius of curvature and the second section radius of curvature is in the range of 0.65" to 0.85".

14. The fitment of claim 9, further comprising a third spout section adjacent the funnel region and a fourth spout section adjacent the funnel region, the third spout section and the fourth spout section disposed on opposite sides of the funnel region, wherein the third spout section and the fourth spout section extend substantially straight away from the funnel region.

15. A fitment for a container, comprising:

a spout;

a lower portion having a lower portion side wall; and a floor;

wherein the floor of the fitment includes a frangible perimeter defining a removable inner portion, wherein the fitment is in a closed position when the removable inner portion is coupled to the fitment floor via the frangible perimeter;

wherein the removable inner portion may be removed from the fitment floor to provide the fitment in an open position in which liquid contents may flow through the fitment floor;

wherein the removable inner portion is coupled to a pull ring configured to allow a user to grasp the pull ring and remove the removable inner portion;

wherein the spout of the fitment includes a spout wall extending from a first end to a second end an angular distance $\alpha_1$;

wherein angular distance $\alpha_1$ is less than 230 degrees;

wherein the floor includes a first section, a second section, a third section, and a fourth section, wherein the first section extends away from the lower portion side wall at a first floor angle $\beta_1$, wherein the fourth section extends away from the lower portion side wall at a second floor angle $\beta_2$, and wherein the fourth section extends away from the third section at a third floor angle $\beta_3$; and wherein the first floor angle $\beta_1$ is in the range of 120 degrees to 130 degrees, and wherein the third floor angle $\beta_3$ is in the range of 140 degrees to 150 degrees.

16. The fitment of claim 15, wherein the second section extends away from the first section at a fourth floor angle $\beta_4$.

17. The fitment of claim 16, wherein the third section extends away from the second section at a fifth floor angle $\beta_5$.

18. The fitment of claim 17, wherein the second floor angle $\beta_2$ is in the range of 120 degrees to 130 degrees, the fourth floor angle $\beta_4$ is in the range of 146 degrees to 156 degrees, and the fifth floor angle $\beta_5$ is in the range of 169 degrees to 179 degrees.

19. The fitment of claim 17, wherein fifth floor angle $\beta_5$ is at least partially in the removable portion.

20. The fitment of claim 15, wherein the lower portion side wall includes at least one fitment protrusion to facilitate retention of the fitment in the container.

* * * * *